US011185756B2

(12) United States Patent
Frankling

(10) Patent No.: US 11,185,756 B2
(45) Date of Patent: Nov. 30, 2021

(54) GROIN AREA SHIELD

(71) Applicant: David T. Frankling, Belleville, MI (US)

(72) Inventor: David T. Frankling, Belleville, MI (US)

( * ) Notice: Subject to any disclaimer, the term of this patent is extended or adjusted under 35 U.S.C. 154(b) by 732 days.

(21) Appl. No.: 15/958,336

(22) Filed: Apr. 20, 2018

(65) Prior Publication Data

US 2018/0236344 A1 Aug. 23, 2018

Related U.S. Application Data

(63) Continuation of application No. 14/557,914, filed on Dec. 2, 2014, now abandoned.

(60) Provisional application No. 61/914,508, filed on Dec. 11, 2013.

(51) Int. Cl.

| | |
|---|---|
| ***A63B 71/12*** | (2006.01) |
| ***A41D 13/05*** | (2006.01) |
| *A63B 102/24* | (2015.01) |
| *A63B 102/14* | (2015.01) |
| *A63B 102/18* | (2015.01) |

(52) U.S. Cl.

CPC ..... *A63B 71/1216* (2013.01); *A41D 13/05* (2013.01); *A41D 13/0525* (2013.01); *A41D 13/0562* (2013.01); *A63B 2102/14* (2015.10); *A63B 2102/18* (2015.10); *A63B 2102/24* (2015.10); *A63B 2209/10* (2013.01)

(58) Field of Classification Search

CPC ..... A41D 13/0543; A41D 13/0525; A41D 13/015; A41D 13/05; A41D 13/00; A41D 13/0015; A41D 13/0156; A41D 13/0575; A41D 13/0562; A41D 13/0002; A41D 13/055; A41D 13/0556; A41D 1/06; A41D 1/088; A63B 71/1225; A63B 71/1216; A63B 71/12

USPC ..... 2/238, 464, 466, 23, 2; 128/891

See application file for complete search history.

(56) References Cited

U.S. PATENT DOCUMENTS

| | | | |
|---|---|---|---|
| 1,720,439 | A | 7/1929 | Richardson |
| 1,972,275 | A | 9/1934 | Record |
| 4,922,899 | A | 5/1990 | Graff et al. |
| 5,154,187 | A | 10/1992 | Brownlee |
| 5,174,307 | A | 12/1992 | Thompson |
| 5,479,942 | A | 1/1996 | DiMatteo |
| 5,561,865 | A | 10/1996 | Fjelstul |
| 5,819,323 | A | 10/1998 | Edenfield |
| 5,920,914 | A | 7/1999 | Dempsey |
| 7,004,921 | B2 | 2/2006 | Littell |
| 7,178,176 | B1 | 2/2007 | S-Cronenbold |
| D571,047 | S | 6/2008 | Kamradt |
| D593,258 | S | 5/2009 | Kamradt |
| 7,712,156 | B2 | 5/2010 | Raber |
| 7,917,917 | B2 | 4/2011 | Kamradt |
| 2005/0177931 | A1 | 8/2005 | Tsujimoto |

(Continued)

*Primary Examiner* — Katharine G Kane

(74) *Attorney, Agent, or Firm* — Brooks Kushman P.C.

(57) ABSTRACT

An athletic garment for protecting genitals of a user includes shorts having a pair of leg receiving portions and a flap defining a pocket centered in a groin region. The pocket extends in front of a portion of each of the leg receiving portions. A protective shield is disposed within the pocket and includes an arch portion and left and right wings extending laterally outward from opposing sides of the arch portion. The left wing extends over a portion of one of the leg receiving portions and the right wing extends over a portion of the other of the leg receiving portions.

14 Claims, 5 Drawing Sheets

(56) References Cited

U.S. PATENT DOCUMENTS

| | | | |
|---|---|---|---|
| 2010/0024105 | A1 | 2/2010 | Sims |
| 2013/0074251 | A1 | 3/2013 | Crye et al. |

GROIN AREA SHIELD

CROSS-REFERENCE TO RELATED APPLICATIONS

This application is a continuation of U.S. application Ser. No. 14/557,914 filed Dec. 2, 2014, which, in turn, claims the benefit of U.S. provisional application Ser. No. 61/914,508 filed Dec. 11, 2013, the disclosures of which are hereby incorporated in their entirety by reference herein.

TECHNICAL FIELD

This invention relates to protective shields for athletic competition that are intended to protect the groin area of a participant from injury.

BACKGROUND

In a wide variety of athletic competitions there is a risk of injury to a participant's groin area that may be caused by contact with another competitor, a flying projectile, or a fixed object. In sports such as hockey, baseball, lacrosse, and the like, a puck or ball potentially travelling at speeds greater than 100 miles per hour may be driven into contact with a participant. If the puck or ball is driven into the groin area of the participant a painful and debilitating injury may be suffered.

Athletic cups placed within a supporter are the conventional form of protection from such injuries. Cups are uncomfortable and may impede leg movement while running or skating and may limit the participant's speed and effectiveness. Referring to FIG. 1 a cup as disclosed in U.S. Pat. No. 7,712,156 is illustrated by way of example. If an object contacts the cup above the widest part of the cup, the force of the impact is applied to the pubic bone and the tendons and ligaments sides of the groin an may result in a painful injury. If an object contacts the cup below the widest part of the cup, the force of the impact may drive the cup into the participant's genitalia and may result in a more painful injury.

A newer design of a cup sold under the trademark "The NuttyBuddy®" as disclosed in U.S. Pat. No. 7,004,921 is shown in FIG. 2 to include a rigid shield that is contoured around the testicles and includes curved portions that extend above and below the part of the shield that protects sensitive areas near the testicles. This device, especially if not well fitted, may also impede leg movement while running or skating. This approach provides greater protection for the testicles but forces applied to the upper portion of the device must be absorbed by the abdominal muscle wall. Forces applied to the device to the lower portion of the device are directed to the tendons and ligaments on the sides of the groin area or the genitalia and may also result in a painful injury.

The groin area shield disclosed in the attached drawings and the following description is directed to solving the above problems and other problems.

SUMMARY

Figure 1:
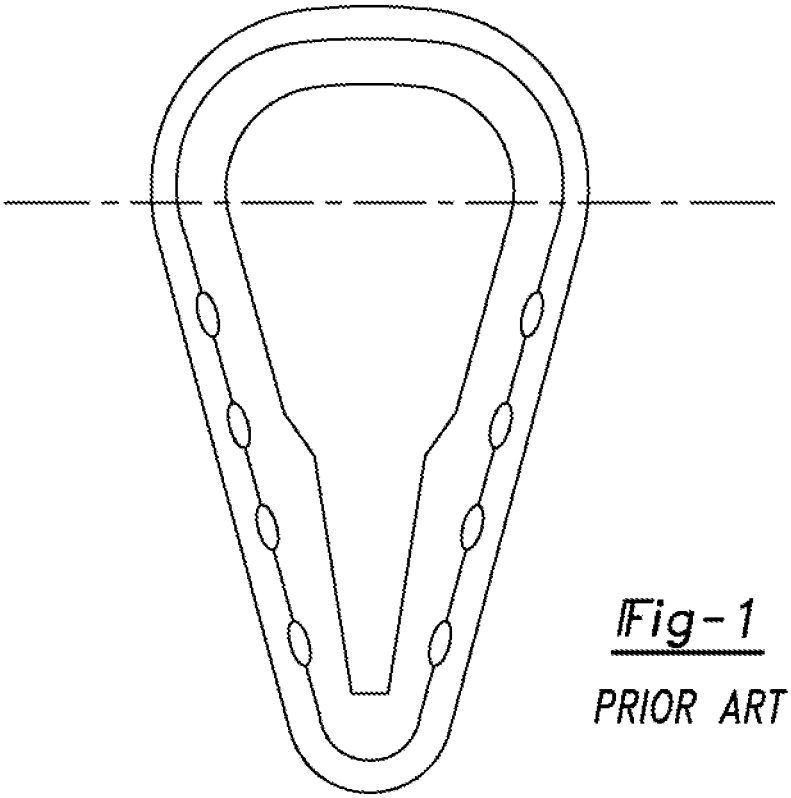
Fig-1 PRIOR ART
FIG. 1 is a front elevation view of a prior art protective cup.
Figure 2:
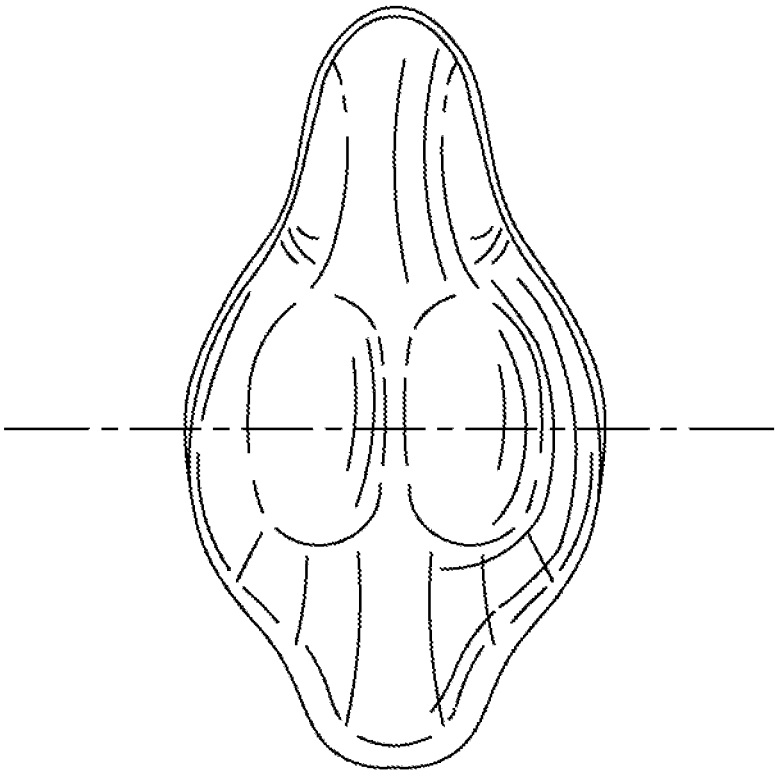
Fig-2 PRIOR ART
FIG. 2 is a front elevation view of a prior art contoured shield type of protective cup.

According to one aspect of this disclosure an athletic garment for protecting genitals of a user includes shorts having a pair of leg receiving portions and a flap defining a pocket centered in a groin region. The pocket extends in front of a portion of each of the leg receiving portions. A protective shield is disposed within the pocket and includes an arch portion and left and right wings extending laterally outward from opposing sides of the arch portion. The left wing extends over a portion of one of the leg receiving portions, and the right wing extends over a portion of the other of the leg receiving portions. Each of the wings may include an arcuate portion contoured to match the shape of a user's thigh.

The athletic garment may also include raised ribs extending between the arch portion and each of the left and right wings to increase stiffness of the shield. Each of the left and right wings may also include at least one corner portion connected to each of the left and right wings by a living hinge.

According to another aspect of this disclosure an athletic protection device includes a protective shield for protecting male genitals. The shield includes an arch portion shaped to protect the genitals, and a pair of wings extending from opposing sides of the arch portion to engage a thigh a user.

The athletic protection device may also include raised ribs extending between the arch portion and each of the wings to increase stiffness of the shield. The athletic protection device may be secured to the user with compression shorts. The compression shorts may include a pair of leg receiving portions and a flap defining a pocket centered in a groin region and extending in front of a portion of each of the leg receiving portions. The protective shield may be disposed within the pocket with each of the wings extending in front of a portion of one of the leg receiving portions.

The athletic protection device may also be attached to the compression shorts with hook and loop fasteners rather than a pocket. Here, the arch portion is centered over the groin region and each of the wings extends partly across one of the leg receiving portions. Each of the wings may be secured to the compression shorts with hook and loop fasteners.

According to yet another aspect of this disclosure a protective shield for male genitals includes an arch portion shaped to shield the genitals, and left and right wings extending from opposing lateral sides of the arch portion. The left wing is shape to be held against the left thigh of a user and the right wing in shape to be held against the right thigh of the user. When in use, an impact to the arch portion is transferred to the first impact flow path extending between the arch portion and the right-wing, and into a second impact flow path extending between the arch portion and the left wing. The impact force applied to the arch portion is transferred along the first flow path into the right thigh, and is transferred along the second flow path into the left thigh.

DETAILED DESCRIPTION

The illustrated embodiments are disclosed with reference to the drawings. However, it is to be understood that the disclosed embodiments are intended to be merely examples that may be embodied in various and alternative forms. The figures are not necessarily to scale and some features may be exaggerated or minimized to show details of particular components. The specific structural and functional details disclosed are not to be interpreted as limiting, but as a representative basis for teaching one skilled in the art how to practice the disclosed concepts.

Figure 3:
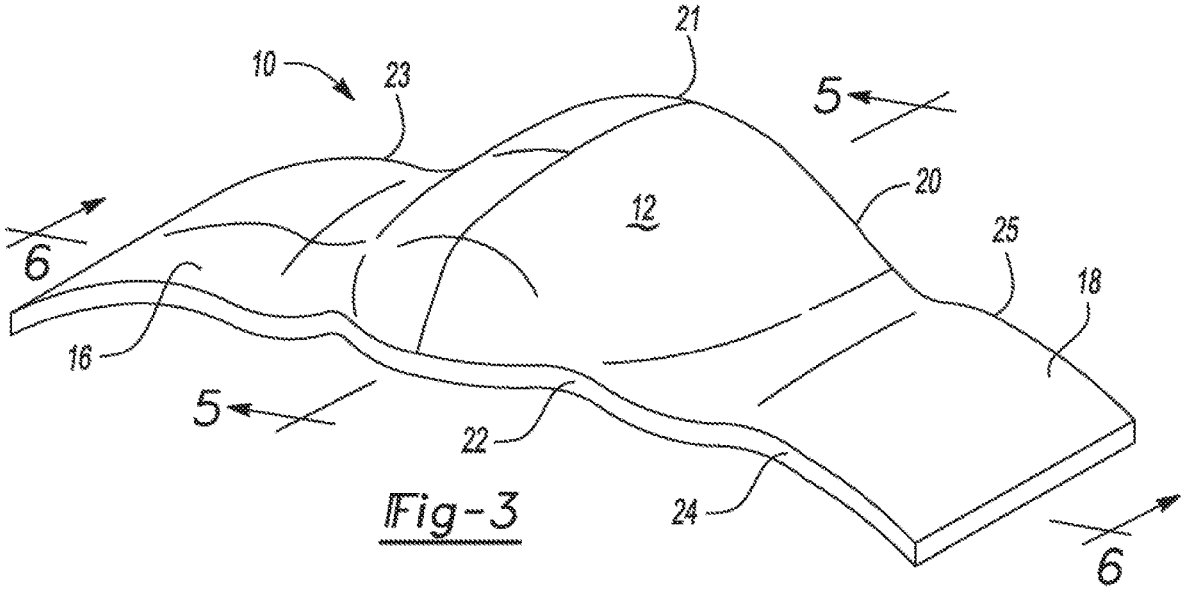
FIG. 3 is a perspective view of a groin area protective shield made according to a first embodiment of the present invention.

Referring to FIG. 3, a groin area protective shield 10 made according to one aspect of this invention disclosure is illustrated. The groin area protective shield 10 includes a groin area arch 12 that is flanked on right and left sides by a right thigh support wing 16 and a left thigh support wing 18. The groin area protection shield 10 is made from rigid polyethylene polymer filled with approximately 20% talc. Alternatively, the shield can be made from acrylic, polystyrene or polyurethane polymers that are filled or fiber reinforced to obtain the desired level of strength and stiffness. The groin area shield is either molded to shape or formed into shape from a flat blank of the desired polymer. The groin area shield 10 is intended to be used in place of a conventional cup.

The top of the shield is defined by a top edge 20 and the bottom of the shield is defined by a bottom edge 22. The top edge 20 includes an arch portion upper side 21, a left wing upper side 23 and a right wing upper side 25. The arch portion upper side 21 defines the upper most point of the top edge 22. The upper sides 23, 25 are lower than the arch portion upper side 21. (i.e. when worn, the upper sides 23, 25 are at a lower height than the arch portion upper side 21.)

The groin area arch 12 is of greater depth near the top edge 20 to conform to the shape of a person's lower abdomen just above the groin area. The depth of the groin area arch 12 is reduced in the lower portion of the groin area shield and is approximately co-extensive with the right thigh support wing 16 and the left thigh support wing 18 in the forward direction when worn by a person. Each of the wing 16, 18 includes an arcuate portion 24 sized and shaped to match a user's thigh for increased comfort and better fit.

Figure 4:
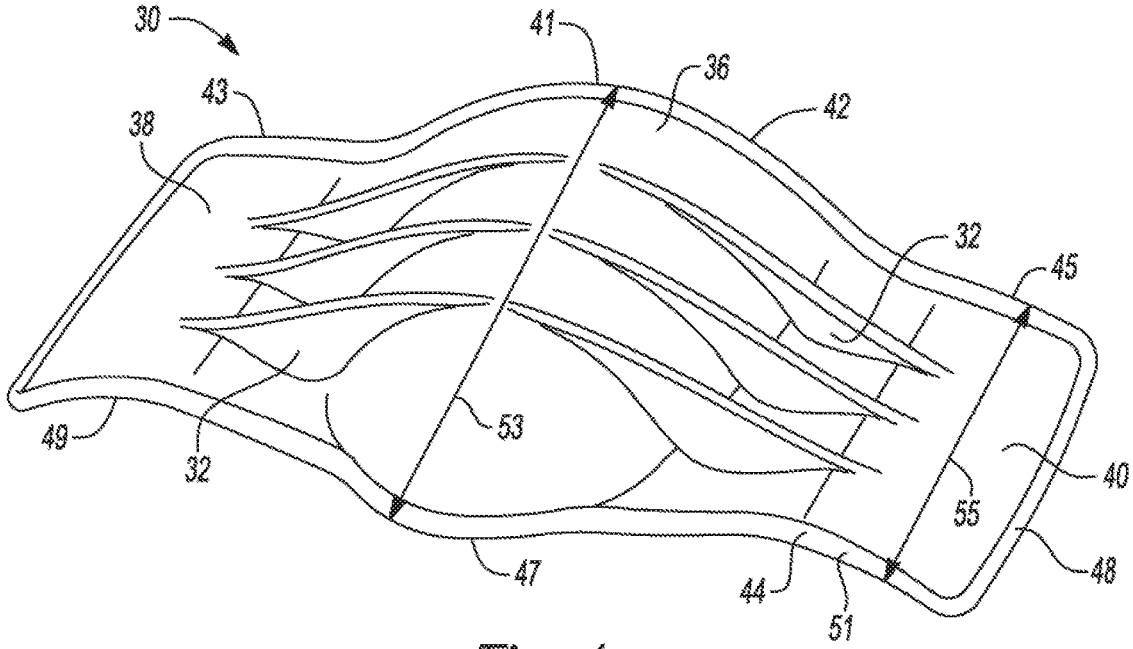
FIG. 4 is a perspective view of a groin area protective shield made according to a second embodiment of the present invention.

Referring to FIG. 4, an alternative embodiment of a groin area protection shield 30 is illustrated that includes a plurality of bridging ribs 32 that provide additional reinforcement. The groin area protection shield 30 includes a groin area arch 36 that is flanked on right and left sides by a right thigh support wing 38 and a left thigh support wing 40. The bridging ribs 32 extend from the groin area arch 36 to the right thigh support wing 38 and a left thigh support wing 40. The bridging ribs 32 resist compression, or rearward deflection, of the groin area arch 36. The bridging ribs 32 and 40 also function to maintain the shape of the groin area protection shield 30 across the width of the shield 30 and provide added impact strength.

The top of the shield is defined by a top edge 42 and the bottom of the shield is defined by a bottom edge 44. The top edge 42 includes an arch portion upper side 41, a left wing upper side 43 and a right wing upper side 45. The upper sides 43, 45 are lower than the arch portion upper side 41. (i.e. when worn, the upper sides 43, 45 at a lower height than the arch portion upper side 41.) The bottom edge 44 includes an arch portion lower side 47, a left wing lower side 49 and a right wing lower side 51. The arch portion has an arch height 53 defined between the arch upper and lower edges 41, 47. Each of the wings 38, 40 has a wing height defined between the wing upper edge and the wing lower edge. For example, the right wing has a wing height 55 defined between the wing upper edge 45 and the wing lower edge 51.

As with the embodiment of FIG. 3, the groin area arch 36 is of greater depth near the top edge 42 to conform to the shape of a person's lower abdomen just above the groin area. The depth of the groin area arch 36 is reduced in the lower portion of the groin area shield and is approximately co-extensive with the right thigh support wing 38 and the left thigh support wing 40 in the forward direction. The perimeter of the groin area protection shield 30 is shown with a rounded thickened edge 48 that adds to the structural rigidity of the shield 30 and also prevents chaffing or irritation of the skin by the shield.

Figure 5:
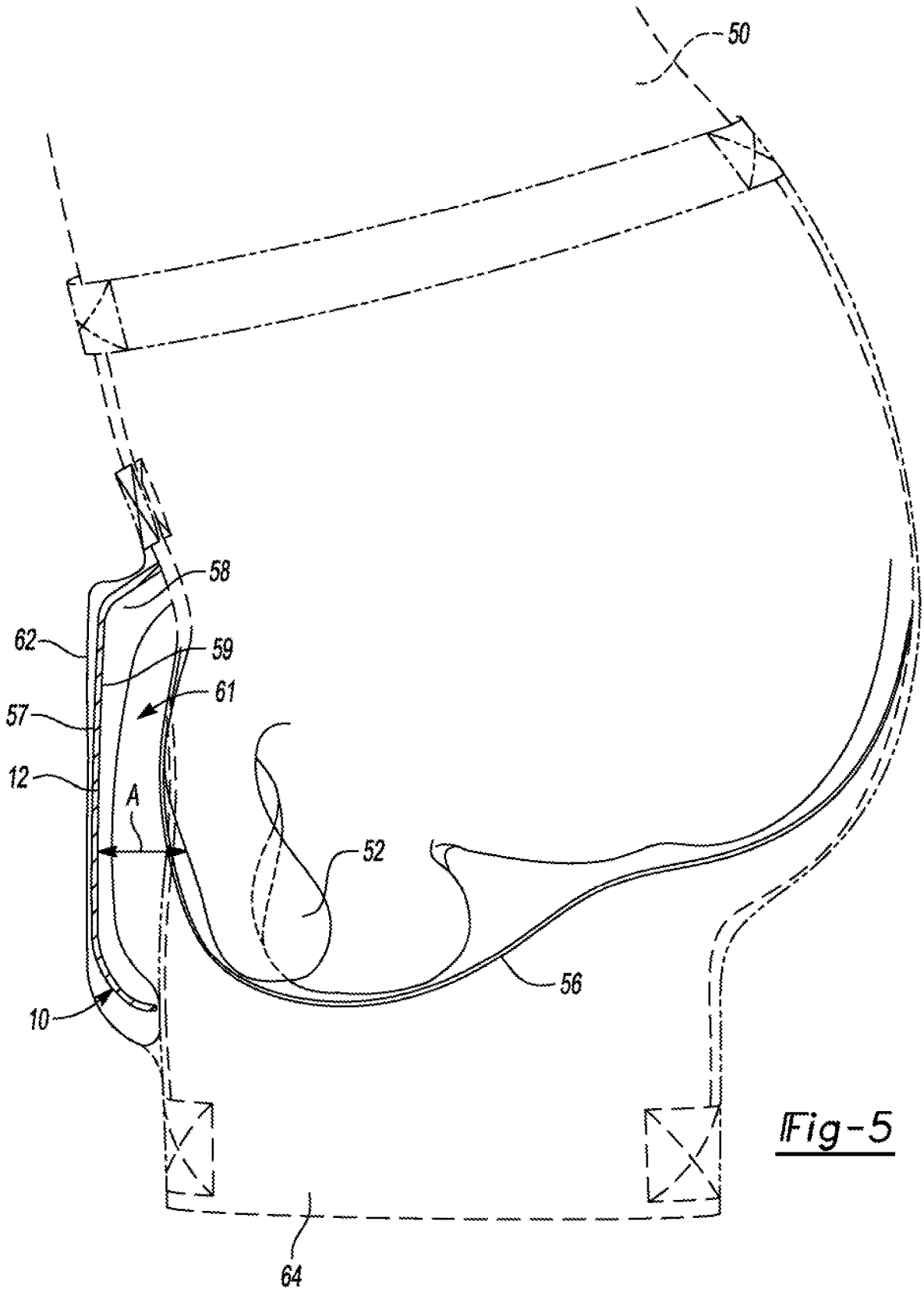
FIG. 5 is a vertical cross-sectional view taken along the line 5-5 in FIG. 3.

Referring to FIG. 5, the groin area protection shield 10 shown in FIG. 3 is shown in a vertical cross-sectional view as worn by a person 50 over their genitalia 52 in a pair of compression shorts 56. The arch portion of the protective shield 10 includes an outside surface 57 and an inside surface 59 that defines a cavity 61 configured to receive the genitalia 52. The right thigh support wing 16 and left thigh support wing 18 are held firmly against the top portion of the person's thighs by the compression shorts 56. The compression shorts 56 may have a pair of leg receiving portions 64, and a flap 62 that defines a pocket 58 for receiving the groin area protection shield 10 therein. The pocket 58 is centered over the genitalia or groin region 52 and extends in front of a portion of each of the leg receiving portions 64. The left wing 18 extends over portion of one of the leg receiving portions and the right wing 16 extends over a portion of the other of the leg receiving portions.

Alternatively, a strip of Velcro® hook and loop fastening material (not shown) may be provided on the groin area protection shield 10 and compression shorts 56 to hold the shield in place in front of the genitalia 52 in lieu of the pocket 58.

The arrow "A" shown in FIG. 5 indicates the desired spacing between the groin area arch 12 and the person's genitalia 52. The spacing "A" permits limited deflection of the shield 10 while preventing contact by the shield against the genitalia 52. The groin area arch 12 of the groin area protection shield 10 extends from well above to a point below the person's genitalia 52. The compression shorts 56 envelop the genitalia 52 from below restricting movement to a limited extent without impeding leg movement.

Figure 6:
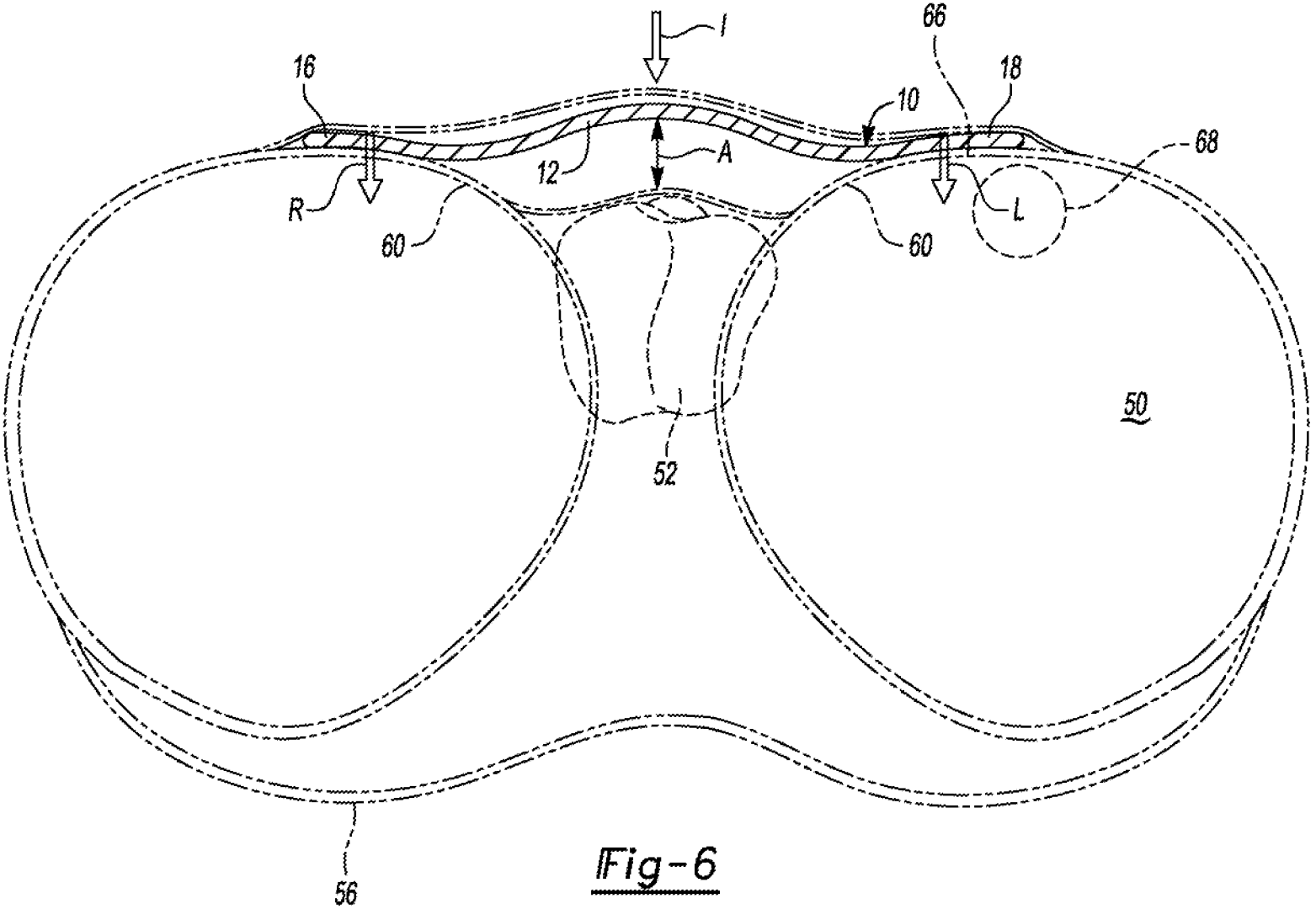
FIG. 6 is a horizontal cross-sectional view taken along the line 6-6 in FIG. 3.

Referring to FIG. 6, the groin area protection shield 10 shown in FIG. 3 is shown from below in a horizontal cross-sectional view as worn by a person 50 over their genitalia 52 in a pair of compression shorts 56. The arrow "A" again indicates the spacing between the groin area arch 12 and the genitalia 52. Arrow "I" indicates an impact force applied to the groin area arch 12 in an athletic competition such as an impact from a hockey puck, a lacrosse ball, baseball, or the like. The impact force "I" is transferred by the groin area arch 12 to the right thigh wing 16 and the left thigh wing 18. Force arrows "R" & "L" indicate the forces that are, in turn, applied to the upper portion of the thighs 60. The upper portions of the thighs 60 are protected by substantial muscle mass and resistant to injury unlike the sensitive genitalia or the tendons and ligaments on the sides of the person's groin area.

In the embodiment of FIG. 4, a similar transfer of the impact force occurs but the bridging ribs 32 and 40 increase the level of force that may be transferred from the groin area arch 36 to the right thigh wing 38 and the left thigh wing 40. The bridging ribs also increase the resistance to compression of the groin area arch 36.

The left and right wings 16, 18 are held firmly against the user's thigh. In some embodiments the left and right wings 16, 18 are shaped to extend across the anterior portion 66 of the user's thigh muscle. The left and right wings 16, 18 may also be shaped to extend across at least a portion of the sartorius muscle 68 of the user's thigh.

Figure 7:
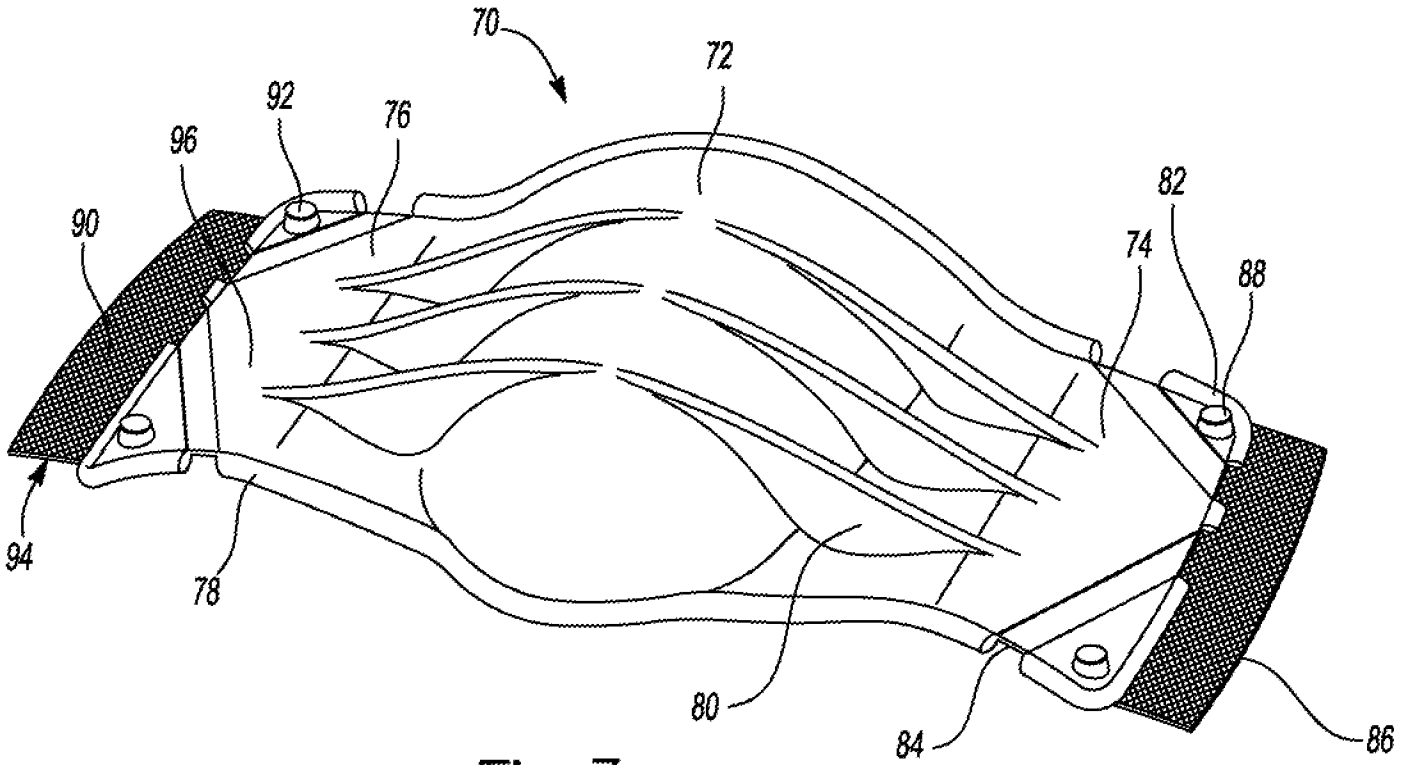
FIG. 7 is a perspective view of a groin area protective shield made according to a third embodiment of the present invention.

Referring to FIG. 7, an alternative embodiment of a groin area protection shield 70 includes a groin area arch 72 that is flanked on right and left sides by a right thigh support wing 74 and a left side support wing 76. Each of the wings 74, 76 includes an arcuate portion 78. A plurality of ribs 80 extend between the arch portion 72 and each of the wings 74, 76. Each of the wings 74, 76 includes at least one corner portion 82 flexibly attached to the wing with a living hinge 84.

In the illustrated embodiment, two living hinges 84 are diagonally oriented relative to an intermediate portion 96. Two corner portions 82 are flexibly attached to the intermediate portion 96 by the living hinges 84. The living hinges 84 are thinner than the corner portions 82 and the intermediate portions 96. The living hinge 84 provides flexibility in the corner areas where the corner portions contact 82 the thighs while the intermediate portion provides stiffness that facilitates the transfer of the force of an impact applied to the groin area arch 72 to the thighs.

A first flap 86 is attached to an outer edge of the right wing 74 with a pair of rivets 88, and a second flap 90 is attached to an outer edge of the left-wing 76 with a pair of rivets 92. Each of the flaps 86, 90 includes an attachment side 94 having hook and loop fasteners (i.e. Velcro®). Alternatively, the flaps may be omitted and the shield 70 may be received within a pocket on a pair of compression shorts.

While exemplary embodiments are described above, it is not intended that these embodiments describe all possible forms of the disclosed apparatus and method. Rather, the words used in the specification are words of description rather than limitation, and it is understood that various changes may be made without departing from the spirit and scope of the disclosure as claimed. The features of various implementing embodiments may be combined to form further embodiments of the disclosed concepts.

What is claimed is:

1. An athletic garment for protecting a groin region of a user comprising:

shorts including a pair of leg receiving portions and a flap defining a pocket centered in the groin region and extending in front of a portion of each of the leg receiving portions; and a protective shield disposed within the pocket and including:

an arch portion shaped to protect the groin region and having an arch upper edge, an arch lower edge, and opposing sides extending between the arch upper and lower edges, the arch portion further having an interior surface defining a cavity configured to cover the groin region and an exterior surface opposite the interior surface, wherein the arch portion has an arch height defined between the arch upper and lower edges, and the arch height has a vertical midpoint, wherein the vertical midpoint is centrally located between the upper and lower edges, and a pair of left and right wings each extending from one of the opposing sides and having an inside surface shaped to extend across and be supported by an anterior portion of a thigh muscle of the user to thereby create spacing (A) between the arch portion and the user's genitalia; wherein the spacing prevents contact to the user's genitalia during a force of impact and an exterior surface opposite the inside surface, each of the wings further having a wing upper edge continuous with the arch upper edge and a wing lower edge continuous with the arch lower edge, and wherein the inside surface of each wing engages by the anterior portion of a thigh muscle below the vertical midpoint of the arch height.

2. The athletic garment of claim 1 wherein the protective shield further includes a first set of raised ribs extending laterally between the arch portion and the left wing to increase stiffness of the shield, wherein the raised ribs each project outwardly from the exterior surface of the arch portion and the exterior surface of the left wing, and a second set of raised ribs extending laterally between the arch portion and the right wing to increase stiffness of the shield, wherein each raised rib of the second set projects outwardly from the exterior surface of the arch portion and the exterior surface of the right wing.

3. The athletic garment of claim 1 wherein each of the left and right wings further includes at least one corner portion connected to each of the left and right wings by a living hinge.

4. The athletic garment of claim 1 wherein each of the left and right wings are shaped to extend across and be supported by at least a portion of a sartorius muscle of the user's thigh.

5. The athletic garment of claim 1 wherein the interior surface of each of the left and right wings includes an arcuate portion contoured to match a shape of an anterior portion of a user's thigh.

6. The athletic garment of claim 1 wherein each of the left and right wings includes a pair of corner portions that are each attached by a living hinge, wherein the corner portions are flexibly connected to an intermediate portion of each of the wings.

7. An athletic protection device comprising:

a protective shield for protecting male genitals of a user, the shield including:

an arch portion shaped to protect the genitals and having an arch upper edge, an arch lower edge, and opposing sides extending between the arch upper and lower edges, the arch portion further having an interior surface defining a cavity configured to cover the genitals and an exterior surface opposite the interior surface, wherein the arch portion has an arch height defined between the arch upper and lower edges, and the arch height has a vertical midpoint, wherein the vertical midpoint is centrally located between the upper and lower edges, and a pair of wings each extending from one of the opposing sides and having an inside surface shaped to extend across and be supported by an anterior portion a thigh muscle of the user to thereby create a spacing (A) between the arch portion and the user's genitalia; wherein the spacing prevents contact to the user's genitalia during a force of impact and an exterior surface opposite the inside surface, each of the wings further having a wing upper edge continuous with the arch upper edge and a wing lower edge continuous with the arch lower edge, and wherein the inside surface of each wing engages the anterior portion of a thigh muscle below the vertical midpoint of the arch height.

8. The athletic protection device of claim 7 further including a set of raised ribs extends laterally between the arch portion and one of the wings to increase stiffness of the shield, wherein the raised ribs each project outwardly from the exterior surface of the arch portion and the exterior surface of the one of the wings.

9. The athletic protection device of claim 8 wherein the exterior surface of the arch portion projects outwardly from the exterior surfaces of the wings so that the arch portion is raised from the wings.

10. The athletic protection device of claim 8 wherein a second set of raised ribs extends laterally between the arch portion and the other of the wings to increase stiffness of the shield, wherein each raised rib of the second set projects outwardly from the exterior surface of the arch portion and the exterior surface of the other of the wings.

11. The athletic protection device of claim 7 wherein each of the wings includes at least one corner portion attached by a living hinge, wherein the corner portions are flexibly connected to an intermediate portion of each of the wings.

12. The athletic protection device of claim 7 wherein the interior surface of each of the wings includes an arcuate portion contoured to match a shape of an anterior portion of the thigh.

13. The athletic garment of claim 7 wherein each of the left and right wings are shaped to extend across and be supported by at least a portion of a sartorius muscle of the thigh.

14. The athletic garment of claim 1 wherein the protective shield further includes raised ribs extending laterally between the arch portion and the wings, and wherein the raised ribs each project outwardly from the exterior surface of the arch portion and the exterior surface of the wings to increase stiffness of the shield.

* * * * *